US005186761A

United States Patent [19]

Kobayashi et al.

[11] Patent Number: 5,186,761

[45] Date of Patent: * Feb. 16, 1993

[54] MAGNETIC ALLOY AND METHOD OF PRODUCTION

[75] Inventors: Osamu Kobayashi; Koji Akioka; Tatsuya Shimoda, all of Nagano, Japan

[73] Assignee: Seiko Epson Corporation, Tokyo, Japan

[ * ] Notice: The portion of the term of this patent subsequent to Dec. 31, 2008 has been disclaimed.

[21] Appl. No.: 815,659

[22] Filed: Dec. 31, 1991

Related U.S. Application Data

[63] Continuation of Ser. No. 638,014, Jan. 7, 1991, Pat. No. 5,076,861, which is a continuation of Ser. No. 527,687, May 21, 1990, abandoned, which is a continuation of Ser. No. 101,609, Sep. 28, 1987, abandoned.

[30] Foreign Application Priority Data

Apr. 30, 1987 [JP] Japan ..... 62-104622

[51] Int. Cl.[5] ..... H01F 1/04

[52] U.S. Cl. ..... 148/101; 148/302; 252/62.057; 252/62.058

[58] Field of Search ..... 148/101, 302; 252/62.57, 62.58

[56] References Cited

U.S. PATENT DOCUMENTS 4,536,233 8/1985 Okonogi et al. .
4,664,724 5/1987 Mizoguchi et al. .
4,767,474 8/1988 Fujimura et al. .

(List continued on next page.)

FOREIGN PATENT DOCUMENTS 0106948 5/1984 European Pat. Off. .
0108474 5/1984 European Pat. Off. .
0125752 11/1984 European Pat. Off. .
0126179 11/1984 European Pat. Off. .
0133758 3/1985 European Pat. Off. .
0184722 6/1986 European Pat. Off. .
0187538 7/1986 European Pat. Off. .
0123947 4/1982 Japan .
60-063304 4/1985 Japan .
0076108 4/1985 Japan .

(List continued on next page.)

OTHER PUBLICATIONS

Koon, et al., "Magnetic Properties of Amorphous and Crystallized $(Fe_{0.82}B_{0.18})_{0.9}Tb_{0.05}La_{0.05}$", Applied Physics Letters, vol. 39, No. 10, pp. 840–842, Nov., 1981.

Kabacoff, et al., "Thermal and Magnetic Properties of Amorphous $Pr_x(Fe_{0.8}B_{0.2})_{1-x}$", Journal of Applied Physics, vol. 53, No. 3, pp. 2255–2257, Mar., 1982.

Pinkerton, "Quench Rate Dependence of the Initial Magnetization in Rapidly Solidified Neodymium-Iron-Boron Ribbons", IEEE Transactions on Magnetics, vol. Mag. 22, No. 5, pp. 922–924, Sep., 1988.

(List continued on next page.)

*Primary Examiner*—Jacqueline Howard
*Attorney, Agent, or Firm*—Blum Kaplan

[57] ABSTRACT

An anisotropic magnetic alloy having a columnar macrostructure is provided. The magnetic alloy is prepared by melting and casting an R-Fe-B alloy in order to make a magnetic alloy having a columnar macrostructure and heat treating the cast alloy at a temperature of greater than or equal to about 250° C. in order to magnetically harden the magnetic alloy. Alternatively, the cast alloy can be hot processed at a temperature greater than or equal to about 500° C. in order to align the axes of the crystal grains in a specific direction and make the magnetic alloy anisotropic. In another embodiment, the cast alloy can be hot processed at a temperature of greater than or equal to about 500° C. and then heat treated at a temperature of greater than or equal to about 250° C.

15 Claims, 1 Drawing Sheet

U.S. PATENT DOCUMENTS 4,773,950 9/1988 Fujimura et al. .
4,834,812 5/1989 Ghandehara .
4,894,097 1/1990 Iijima et al. .
4,902,361 2/1990 Lee et al. .
5,076,861 12/1991 Kobayashi et al. ..... 148/101

FOREIGN PATENT DOCUMENTS 60-152008 8/1985 Japan .
60-218457 11/1985 Japan .
1081604 4/1986 Japan .
1081605 4/1986 Japan .
61-268006 11/1986 Japan .
2203302 9/1987 Japan .
63-18604 1/1988 Japan .
3213320 9/1988 Japan .

OTHER PUBLICATIONS

Mishra, et al, "Miscrostructure, Domain Walls, and Magnetization Reversal in Hot-Pressed Nd-Fe-B Magnets", Applied Physics Letters, vol. 48, No. 11, pp. 733-735, Mar., 1986.

Mizoguchi, et al., "Nd-Fe-B-Co-Al Based Permanent Magnets with Improved Magnetic Properties and Temperature Characteristics", Applied Physics Letters, vol. 48, No. 19, pp. 1309-1310, May, 1986.

Lee, "Hot-Pressed Neodymium-Iron-Boron Magnets", Applied Physics Letters, vol. 46, No. 8, pp. 790-791, Apr. 15, 1985.

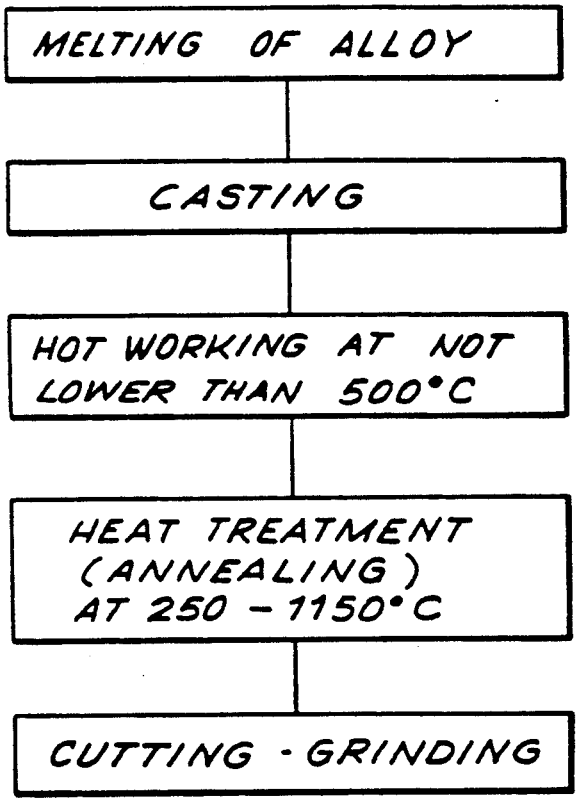
MELTING OF ALLOY
CASTING
HOT WORKING AT NOT LOWER THAN 500°C
HEAT TREATMENT (ANNEALING) AT 250 - 1150°C
CUTTING · GRINDING

MAGNETIC ALLOY AND METHOD OF PRODUCTION

BACKGROUND OF THE INVENTION

The invention relates to magnetic alloys including rare earth elements, iron and boron as primary ingredients, and more particularly to an anisotropic magnetic alloy having a columnar macrostructure.

Permanent magnets are used in a wide variety of applications ranging from household electrical appliances to peripheral console units of large computers. The demand for permanent magnets that meet high performance standards has grown in proportion to the demand for smaller, higher efficiency electrical appliances.

Typical permanent magnets include alnico magnets, hard ferrite magnets and rare earth element—transition metal magnets. In particular, good magnetic performance is provided by rare earth element —transition metal magnets such as R-Co and R-Fe-B permanent magnets.

Several methods are available for manufacturing R-Fe-B permanent magnets, including:

1. A sintering method based on powder metallurgy techniques;

2. A resin bonding technique involving rapidly quenching ribbon fragments having thicknesses of about 30 μ. The ribbon fragments are prepared using a melt spinning apparatus of the type used for producing amorphous alloys; and 3. A two-step hot pressing technique in which a mechanical alignment treatment is performed on rapidly quenched ribbon fragments prepared using a melt spinning apparatus.

The sintering method is described in Japanese Laid-Open Application No. 46008/1984 and in an article by M. Sagawa, S. Fujimura, N. Togawa, H. Yamamoto and Y. Matushita that appeared in Journal of Applied Physics, Vol. 55(6), p. 2083 (Mar. 15, 1984). As described in the article, an alloy ingot is made by melting and casting. The ingot is pulverized to a fine magnetic powder having a particle diameter of about 3 μ. The magnetic powder is kneaded with a wax that functions as a molding additive and the kneaded magnetic powder is press molded in a magnetic field in order to obtain a molded body. The molded body, called a "green body" is sintered in an argon atmosphere for one hour at a temperature between about 1000° C. and 1100° C. and the sintered body is quenched to room temperature. The quenched green body is heat treated at about 600° C. in order to increase further the intrinsic coercivity of the body.

The sintering method described requires grinding of the alloy ingot to a fine powder. However, the R-Fe-B series alloy wherein R is a rare earth element is extremely reactive in the presence of oxygen and, therefore, the alloy powder is easily oxidized. Accordingly, the oxygen concentration of the sintered body increases to an undesirable level. When the kneaded magnetic powder is molded, wax or additives such as, zinc stearate are required. While efforts to eliminate the wax or additive are made prior to the sintering process, some of the wax or additive inevitably remains in the magnet in the form of carbon, which causes the magnetic performance of the R-Fe-B alloy magnet to deteriorate.

Following the addition of the wax or molding additive and the press molding step, the green or molded body is fragile and difficult to handle. This makes it difficult to place the green body into a sintering furnace without breakage and remains a major disadvantage of the sintering method.

As a result of these disadvantages, expensive equipment is necessary in order to manufacture R-Fe-B series magnets according to the sintering method. Additionally, productivity is low and manufacturing costs are high. Therefore, the potential benefits of using inexpensive raw materials of the type required are not realized.

The resin bonding technique using rapidly quenched ribbon fragments is described in Japanese Laid-Open Patent Application No. 211549/1983 and in an article by R. W. Lee that appeared in Applied Physics Letters, Vol. 46(8), p. 790 (Apr. 15, 1985). Ribbon fragments of R-Fe-B alloy are prepared using a melt spinning apparatus spinning at an optimum substrate velocity. The fragments are ribbon shaped, have a thickness of up to 30,μu and are aggregations of grains having a diameter of less than about 1000 Å. The fragments are fragile and magnetically isotropic, because the grains are distributed isotropically. The fragments are crushed to yield particles of a suitable size to form the magnet. The particles are then kneaded with resin and press molded at a pressure of about 7 ton/cm$^2$. Reasonably high densities (−85vol%) have achieved at the pressure in the resulting magnet.

The vacuum melt spinning apparatus used to prepare the ribbon fragments is expensive and relatively inefficient. The crystals of the resulting magnet are isotropic resulting in low energy product and a non-square hysteresis loop. Accordingly, the magnet has undesirable temperature coefficients and is impractical.

Alternatively, the rapidly quenched ribbons or ribbon fragments are placed into a graphite or other suitable high temperature resisting die which has been preheated to about 700° C. in vacuum or inert gas atmosphere. When the temperature of the ribbon or ribbon fragments is raised to 700° C., the ribbons or ribbon fragments are subjected to uniaxial pressure. It is to be understood that the temperature is not strictly limited to 700° C., and it has been determined that temperatures in the range of 725° C.±25° C. and pressures of approximately 1.4 ton/cm$^2$ are suitable for obtaining magnets with sufficient plasticity. Once the ribbons or ribbon fragments have been subjected to uniaxial pressure, the grains of the magnet are slightly aligned in the pressing direction, but are generally isotropic.

A second hot pressing process is performed using a die with a larger cross-section. Generally, a pressing temperature of 700° C. and a pressure of 0.7 ton/cm$^2$ are used for a period of several seconds. The thickness of the material is reduced by half of the initial thickness and magnetic alignment is introduced parallel to the press direction. Accordingly, the alloy becomes anisotropic. By using this two-step hot pressing technique, high density anisotropic R-Fe-B series magnets are provided.

In the two-step hot pressing technique which is described in Japanese Laid-Open Patent Application No. 100402/1985, it is preferable to have ribbons or ribbon fragments with grain particle diameters that are slightly smaller than the grain diameter at which maximum intrinsic coercivity would be exhibited. If the grain diameter prior to the procedure is slightly smaller than the optimum diameter, the optimum diameter will be realized when the procedure is completed because the grains are enlarged during the hot pressing procedure.

The two-step hot pressing technique requires the use of the same expensive and relatively inefficient vacuum melt spinning apparatus used to prepare the ribbon fragments for the resin bonding technique. Futhermore, two-step hot working of the ribbon fragments is inefficient even though the procedure itself is unique.

Accordingly, it is desirable to provide improved methods of preparation of magnetic alloys that are useful in the production of rare earth-iron series permanent magnets, sintered magnets and bonded magnets and further that minimizes the disadvantages encountered in these prior art methods.

SUMMARY OF THE INVENTION

Generally speaking, in accordance with the invention, an anisotropic magnetic alloy having a columnar macrostructure is provided. The magnetic alloy is prepared by melting and casting an R-Fe-B alloy in order to make a magnetic alloy having a columnar macrostructure and heat treating the cast alloy at a temperature of greater than or equal to about 250° C. in order to magnetically harden the magnetic alloy. Alternatively, the cast alloy can be hot processed at a temperature greater than or equal to about 500° C. in order to align the axes of the crystal grains in a specific direction and make the magnet anisotropic. In another embodiment, the cast alloy can be hot processed at a temperature of greater than or equal to about 500° C. and then heat treated at a temperature of greater than or equal to about 250° C. Accordingly, an anisotropic magnetic alloy having a columnar macrostructure is provided.

Accordingly, it is an object of the invention to provide an anisotropic magnetic alloy having a columnar macrostructure.

Another object of the invention is to provide a high performance magnetic alloys which are suitable in the manufacture of rare earth-iron series permanent magnets.

A further object of the invention is to provide a low cost method of manufacturing a magnetic alloy.

Still other objects and advantages of the invention will in part be obvious and will in part be apparent from the specification.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

BRIEF DESCRIPTION OF THE DRAWING

For a fuller understanding of the invention, reference is had to the following description taken in connection with the accompanying drawing, in which the FIGURE is a flow diagram illustrating the steps in preparation of an anisotropic magnetic alloy in accordance with the invention.

DETAILED DESCRIPTION OF THE PREFERRED EMBODIMENTS

Magnetic alloys having sufficient coercive force to be useful as permanent magnets are prepared by casting a molten raw material containing at least one rare earth element, at least one transition metal element and boron in order to provide a cast ingot having fine columnar macrostructure in the composition region. Hot working is performed on the cast ingot in order to make the magnetic alloy anisotropic. Alternatively, heat treatment can be performed on the cast ingot instead of or in addition to hot working. The preferred method for preparing magnetic alloys in accordance with the invention is heat treatment, hot working, heat treatment and hot working.

Since the cast ingot has a fine columnar macrostructure, a magnetic alloy having plane anisotropy can be provided by heat treating the magnetic in a cast state and the resulting degree of alignment of the easy axis of magnetization is about 70%. Hot working can be performed instead of or in addition to heat treatment. Hot working accelerates the speed at which the magnetic alloy becomes uniaxially anisotropic and enhances the degree of alignment of the easy axis of magnetization.

A high performance magnetic alloy is provided using the method provided, which eliminates the step of preparing an alloy in powdered form and the difficulties associated with handling powdered alloys. Since the powdered alloy is not prepared, heat treatment and strict atmospheric control are eliminated productivity is enhanced and equipment cost is reduced.

The optimum composition of an R-Fe-B magnetic alloy is generally considered to be $R_{15}Fe_{77}B_8$ as described in the article by M. Sagawa et al. As can be seen, R and B are richer than in the composition $R_{11.7}Fe_{82.4}B_{5.9}$ values obtained by calculating the main phase $R_2Fe_{14}B$ in terms of percentage. This is due to the fact that R-rich and B-rich non-magnetic phases are necessary in addition to the main phase in order to obtain a coercive force.

In the structure provided, the maximum coercive force is obtained when the boron content is less than the boron content of the main phase composition. This composition range has generally not been considered useful because coercive force is significantly reduced when such powers compositions within this range are sintered. However, enhanced coercive force can be obtained in the low boron compositions within this range when a casting process is used. In fact, it is easy to obtain the coercive force when the boron content is lower than the stoichiometric value and it is difficult to obtain the coercive force when the boron content is higher than the stoichiometric value.

The coercive force mechanism conforms to the nucleation model independent of whether sintering processes or casting processes are used. This can be determined from the fact that the initial magnetization curves of coercive force in both cases show a steep rise such as the curve of $SmCo_5$.

The coercive force of magnetic alloys of this type conforms to a single magnetic domain model. The magnetic alloys has a magnetic domain wall in the crystal grains if the crystal grain diameter of the $R_2Fe_{14}B$ compound is too large. Movement of the magnetic wall reduces the coercive force and demagnetizes the body.

When the crystal grain size is sufficiently small, magnetic walls do not exist in the crystal grains. Consequently, the coercive force increases since demagnetization can be caused only by rotation.

It is necessary for the $R_2Fe_{14}B$ phase to have a grain diameter of about 10 $\mu$m in order to obtain a coercive force. In sintered magnets, the grain diameter can be adjusted by adjusting the powder grain size prior to sintering. When a casting process is used, the size of the crystal grain of the $R_2Fe_{14}B$ compound is determined in the step of solidifying the molten metal. The composition also has a significant influence on grain size. If the composition contains greater than or equal to about 8 atomic percent of boron, the cast $R_2Fe_{14}B$ phase usually has coarse grains and it is difficult to obtain sufficient coercive force unless the rate of quenching is increased.

When the amount of boron is sufficiently low, fine crystal grains can be obtained by selecting appropriate molds, controlling the casting temperature and the like. This low boron region produces a phase richer in iron than the $R_2Fe_{14}B$ compound and iron is first crystallized as a primary crystal in the solidification step. The $R_2Fe_{14}B$ phase then appears as a result of a peritectic reaction. If the quenching rate is greater than the solidifying rate of the equilibrium reaction, the $R_2Fe_{14}B$ phase solidifies around the primary iron crystal. Since the amount of boron decreases, boron rich phases such as $R_{15}Fe_{77}B_8$ are almost non-existent, even though sintered magnets typically have such compositions. Subsequent heat treatment of the cast ingot is carried out in order to diffuse the primary iron crystal and attain an equilibrium state. The coercive force depends significantly on the diffusion of the iron phase. The columnar macrostructure enables the magnet to possess plane anistropy and to have high performance characteristics during hot working.

The intermetallic compound $R_2Fe_{14}B$ wherein R is at least one rare earth element is the source of magnetism of the R-Fe-B magnetic alloy. The compound is arranged so that the easy axis of magnetization, C, is aligned in a plane perpendicular to the columnar crystals when the columnar structures are grown. Specifically, the C axis is not in the direction of columnar crystal growth as might be expected, but is distributed in a plane perpendicular to the direction of crystal growth. Accordingly, the magnetic alloy has anisotropy in a plane. As a result, the magnetic alloy naturally and advantageously has improved performance over magnetic alloys that have equiaxis macrostructures. However, even when a columnar structure is provided, the grain diameter must be fine in order to provide the necessary coercive force. Thus, it is desirable for the boron content to be low.

The use of a columnar macrostructure enhances the effect of hot working with respect to introduction of anisotropy. The degree of magnetic alignment, M.A., is defined as:

$$M.A. = Bx/\sqrt{(Bx^2 + By^2 + Bz^2)} \times 100\ (\%)$$

wherein Bx, By, Bz represent residual magnetic flux density in the x, y and z directions, respectively. The degree of magnetic alignment in an isotropic magnet is about 60% and in a plane anisotropic magnet is about 70%. Hot working is effective to introduce anisotropy, i.e. enhance the degree of magnetic alignment irrespective of the degree of magnetic alignment of the material being processed. However, the higher the degree of magnetic alignment of the original material, the higher the degree of magnetic alignment in the finally processed material. Enhancing the degree of magnetic alignment of the original material by adopting a columnar structure is effective for obtaining a final high performance anisotropic magnet.

The rare earth element used in the magnet compositions prepared in accordance with the invention can be any Lanthanide series element including one or more of yttrium, lanthanum, cerium, praseodymium, neodymium, samarium, europium, gadolinium, terbium, dysprosium, holmium, erbium, thulium, ytterbium and lutium. Praseodymium is preferred. However, praseodymium-neodymium alloys, cerium-praseodymium-neodymium alloys and the like are also preferred. Coercive force can be enhanced by use of a small amount of a heavy rare earth element such as dysprosium and terbium or, alternatively, aluminum, molybdenum or silicon and the like.

As discussed, the main phase of the R-Fe-B magnetic alloy is $R_2Fe_{14}B$. If the content of R is less than about 8 atomic percent, it is not possible to provide a compound having a columnar macrostructure and the compound has a cubic structure like that of an $\alpha$ iron. As a result, suitable magnetic properties are not obtained. However, when the R content exceeds 30 atomic percent, a non-magnetic R-rich phase increases and the magnetic properties deteriorate Thus, the rare earth element is present in an amount between about 8 and 30 atomic percent. Since the magnet is prepared by casting, the R content is preferably between about 8 and 25 atomic percent.

Boron is essential for forming the $R_2Fe_{14}B$ phase. If the boron content is less than about 2 atomic %, a rhombohedral R-Fe structure is formed and a high coercive force is not obtained. When the amount of boron exceeds 8 atomic %, a non-magnetic boron-rich phase increases and the residual magnetic flux density decreases. Thus, boron content of a cast magnetic alloy is preferably between about 2 and 8 atomic %. When the boron content exceeds 8 atomic %, it is difficult to obtain the fine crystal grain size in the $R_2Fe_{14}B$ phase and accordingly the coercive force is reduced.

Cobalt is an effective additional element for increasing the Curie point of the R-Fe-B magnetic alloy. The site of Fe is substituted by Co to form an R2Co14B structure. However, this compound has a small crystal magnetic anisotropy and as the amount is increased the coercive force of the magnetic alloy decreases. It is therefore desirable to use less than or equal to about 50 atomic % of cobalt in order to provide a coercive force of greater than or equal to about 1KOe.

Aluminum has the effect of increasing the coercive force as described in Zhang Maocai et al, Proceedings of the 8th International Workshop of Rare-Earth Magnets, p. 541 (1985). Although this reference is directed to the effect of aluminum on a sintered magnet, the same effect is produced in a cast magnet. However, since aluminum is non-magnetic, the residual magnetic flux density decreases as the amount of aluminum is increased. If the amount of aluminum exceeds 15 atomic %, the residual magnetic flux density is lowered to less than or equal to the flux density of hard ferrite and a high performance rare earth magnet is not obtained. Therefore, the amount of aluminum should be less than or equal to about 15 atomic %.

The invention will be better understood with reference to the following examples. The examples are presented for purposes of illustration only and are not intended to be construed in a limiting sense.

EXAMPLES

FIG. 1 is a flow chart showing the method of preparing a magnetic alloy in accordance with the invention. The alloys having compositions shown in Table 1 were prepared.

TABLE 1

| Example No. | Composition |
|---|---|
| 1 | $Pr_8Fe_{88}B_4$ |
| 2 | $Pr_{14}Fe_{82}B_4$ |
| 3 | $Pr_{20}Fe_{76}B_4$ |
| 4 | $Pr_{25}Fe_{71}B_4$ |
| 5 | $Pr_{14}Fe_{84}B_2$ |
| 6 | $Pr_{14}Fe_{80}B_6$ |
| 7 | $Pr_{14}Fe_{78}B_8$ |
| 8 | $Pr_{14}Fe_{72}Co_{10}B_4$ |
| 9 | $Pr_{14}Fe_{57}Co_{25}B_4$ |
| 10 | $Pr_{14}Fe_{42}Co_{40}B_4$ |
| 11 | $Pr_{13}Dy_2Fe_{81}B_4$ |
| 12 | $Pr_{14}Fe_{80}B_4Si_2$ |
| 13 | $Pr_{14}Fe_{78}Al_4B_4$ |
| 14 | $Pr_{14}Fe_{78}Mo_4B_4$ |
| 15 | $Nd_{14}Fe_{82}B_4$ |
| 16 | $Ce_3Nd_3P_8Fe_{82}B_4$ |
| 17 | $Nd_{14}Fe_{76}Al_4B_4$ |

The alloys were melted in an induction furnace and cast into an iron mold to form a columnar structure. The castings were annealed at 1000° C. for 24 hours and were magnetically hardened as a result.

Each cast ingot was cut and ground to yield a magnet having planar anisotropy obtained by utilizing the anisotropy of the columnar crystals. In the case of isotropic magnets, the cast body was subjected to hot working prior to annealing. Hot working included a hot processing at a temperature of 1000° C. the magnetic properties of each of the magnets are shown in Table 2.

TABLE 2

| Example No. | Cast Magnet iHc (KOE) | Cast Magnet (BH)max (MGOe) | Hot Processed Magnet iHc (KOE) | Hot Processed Magnet (BH)max (MGOe) |
|---|---|---|---|---|
| 1 | 3.5 | 1.9 | 6.2 | 7.5 |
| 2 | 11.0 | 7.3 | 18.3 | 36.9 |
| 3 | 8.2 | 5.7 | 14.5 | 28.3 |
| 4 | 7.0 | 4.2 | 13.7 | 19.4 |
| 5 | 3.4 | 2.5 | 7.2 | 13.5 |
| 6 | 6.7 | 6.8 | 12.4 | 28.4 |
| 7 | 1.5 | 1.5 | 3.5 | 7.0 |
| 8 | 9.5 | 7.0 | 14.9 | 29.7 |
| 9 | 6.0 | 4.5 | 9.2 | 19.9 |
| 10 | 3.5 | 4.3 | 6.2 | 7.6 |
| 11 | 12.9 | 8.0 | 21.0 | 22.7 |
| 12 | 10.7 | 6.5 | 18.9 | 26.8 |
| 13 | 11.7 | 7.9 | 19.6 | 29.4 |
| 14 | 11.8 | 7.4 | 18.6 | 27.6 |
| 15 | 7.7 | 6.3 | 14.3 | 23.0 |
| 16 | 8.2 | 6.8 | 15.8 | 24.3 |
| 17 | 11.7 | 7.8 | 16.0 | 27.0 |

Both $Pr_{14}Ef_{82}B_4$ (Example 15) which exhibited the best performance, and a magnet of $Nd_{15}Fe_{77}B_8$ were cast into an iron mold to form a columnar structure, a vibrating mold to form an equiaxis structure and a ceramic mold to form coarse grains. The magnetic properties of the respective magnets were compared and the results are shown in Table 3.

TABLE 3

| | | Casting Type iHc | Casting Type (BH)max | Casting Type Degree of Orientation | Hot Processing Type iHc | Hot Processing Type (BH)max | Hot Processing Type Degree of Orientation |
|---|---|---|---|---|---|---|---|
| $Pr_{14}Fe_{82}B_4$ | Iron Mold | 11.0 | 7.3 | 72% | 18.3 | 36.9 | 97% |
| | Vibrating Mold | 9.6 | 5.0 | 58% | 12.4 | 17.0 | 87% |
| | Ceramic Mold | 2.5 | 2.4 | 60% | 7.5 | 8.5 | 85% |
| $Nd_{15}Fe_{77}B_8$ | Iron Mold | 1.0 | 1.0 | 70% | 2.5 | 4.1 | 90% |
| | Vibrating Mold | 0.7 | 0.7 | 57% | 2.0 | 3.4 | 82% |
| | Ceramic Mold | 0.2 | 0.3 | 61% | 0.4 | 0.5 | 77% |

As can be seen from Table 3, the composition containing a smaller amount of boron of Example 15 shows a higher magnetic performance. In addition, all of the magnetic properties such as coercive force, maximum energy product and degree of magnetic alignment were improved when a columnar structure was used and were better than the properties of magnets that did not have columnar macrostructures even if the magnets were prepared by casting and hot working. High performance permanent magnets are obtained by heat treating cast ingots without grinding and productivity is advantageously enhanced.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawing(s) shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A rare earth-iron magnetic alloy comprising an alloy of between about 8 to 30 atomic percent of at least one rare earth element, between about 2 and 8 atomic percent boron and the balance iron, wherein said magnetic alloy has a columnar macrostructure and an easy axis of magnetization aligned in a plane perpendicular to the direction of crystal growth.

2. The rare earth-iron magnetic alloy of claim 1, wherein the iron is present in an amount up to about 88 atomic percent.

3. The rare earth-iron magnetic alloy of claim 1, wherein the rare earth element is selected from the group consisting of yttrium, lanthanum, cerium, praseodymium, neodymium, promethium, samarium, europium, gadolinium, terbium, dysprosium, holmium, erbium, thulium, ytterbium, lutetrium and mixtures thereof.

4. The rare earth-iron magnetic alloy of claim 1, wherein the rare earth element is selected from the group consisting of neodymium, praseodymium, cerium and mixtures thereof.

5. The rare earth-iron magnetic alloy of claim 1, further including an effective amount of cobalt for increasing the Curie temperature of a magnet formed from the magnetic alloy.

6. The rare earth-iron magnetic alloy of claim 5, wherein the cobalt is present in an amount up to about 50 atomic percent.

7. The rare earth-iron magnetic alloy of claim 5, wherein cobalt is present in the amount between about 5 to 40 atomic percent.

8. The rare earth-iron magnetic alloy of claim 1, further including an effective amount of at least one coercive force enhancing member selected from the group consisting of aluminum, chromium, molybdenum, tungsten, niobium, tantalum, zirconium, hafnium, titanium, copper and mixtures thereof for enhancing the coercive force of a magnet formed from the magnetic alloy.

9. The rare earth-iron magnetic alloy of claim 1, further including an effective amount of aluminum for enhancing the coercive force of a magnet formed from the magnetic alloy.

10. The rare earth-iron magnetic alloy of claim 8, wherein the coercive force enhancing member is present in an amount up to about 15 atomic percent.

11. The rare earth-iron magnetic alloy of claim 1, further including an effective amount of cobalt for increasing the Curie temperature of the magnetic alloy and an effective amount of at least one member selected from the group consisting of aluminum, chromium, molybdenum, tungsten, niobium, tantalum, zirconium, halfnium, titanium, copper and mixtures thereof for enhancing the coercive force of a magnet formed from the magnetic alloy.

12. The rare earth-iron magnetic alloy of claim 4, further including an effective amount of cobalt for increasing the Curie temperature of the magnetic alloy and an effective amount of at least one selected from the group consisting of aluminum, chromium, molybdenum, tungsten, niobium, tantalum, zirconium, hafnium, titanium, copper and mixtures thereof for enhancing the coercive force of a magnet formed from the magnetic alloy.

13. The rare earth-iron magnetic alloy composition comprising:

at least one rare earth element in an amount between about 8 and 30 atomic percent;

boron in an amount between about 2 and 8 atomic percent;

an effective amount of cobalt for increasing the Curie temperature of a magnet formed from the magnetic alloy;

an effective amount of at least one coercive force enhancing member selected from a group consisting of aluminum, chromium, molybdenum, tungsten, niobium, tantalum, zirconium, halfium, titanium, copper and mixtures thereof for enhancing the coercive force of a magnet formed from the magnetic alloy;

the balance of iron; and wherein the magnetic alloy is anisotropic and has a columnar macrostructure.

14. The rare earth-iron magnetic alloy of claim 12, wherein the rare earth element is selected from the group consisting of neodymium, praseodymium, cerium, and mixtures thereof, cobalt is present in an amount up to about 50 atomic percent and wherein the coercive force enhancing member is aluminum in an amount up to about 50 atomic percent.

15. A method for manufacturing a rare earth-iron magnetic alloy comprising:

casting a molten alloy composition including at least one rare earth element, iron and boron to form an anisotropic cast ingot having a columnar macrostructure.

* * * * *